United States Patent [19]

Forsell et al.

[11] 4,430,631

[45] Feb. 7, 1984

[54] CIRCUIT BREAKER WITH INCREASED CURRENT INTERRUPTING CAPACITY

[75] Inventors: Kenneth A. Forsell, Brown Deer; William E. Grass, Whitefish Bay; Peter J. Theisen, West Bend; Michael J. Fajner, Bayside, all of Wis.

[73] Assignee: Eaton Corporation, Cleveland, Ohio

[21] Appl. No.: 376,801

[22] Filed: May 10, 1982

[51] Int. Cl.[3] ..... H01H 75/00; H01H 77/10; H01H 83/00

[52] U.S. Cl. ..... 335/16; 200/147 R; 335/195; 335/201

[58] Field of Search ..... 335/16, 195, 201; 200/147, 144 R

[56] References Cited

U.S. PATENT DOCUMENTS

| | | | |
|---|---|---|---|
| 1,720,566 | 7/1929 | Pestarini | 335/16 |
| 2,719,203 | 9/1955 | Gelzheiser et al. | 200/144 R |
| 3,243,558 | 3/1966 | Link et al. | 200/144 |
| 3,317,866 | 5/1967 | Hanafusa | 335/16 |
| 3,341,791 | 9/1967 | Leonard | 335/35 |
| 3,467,920 | 9/1969 | Hall et al. | 335/23 |

*Primary Examiner*—Harold Broome
*Attorney, Agent, or Firm*—C. H. Grace; L. G. Vande Zande

[57] ABSTRACT

A narrow width, molded case circuit breaker having parallel, oppositely directed current paths in a conductive stationary contact support (8*c*) and a pivoting movable contact arm (12*b*) to cause separation of the contacts (10, 16) by repelling electromagnetic forces independently of a manual operating mechanism (6, 22) or a trip mechanism (18, 20, 22, 24, 26). An arc runner (8*e*) integral with the stationary contact support (8) has a slot communicating with a vent opening (2*d*) in the case for venting the arc gasses through the arc runner and vent opening. Arc plates (42, 44) are oriented parallel to the arc runner (8*e*) to reduce resistance to movement of the arc therethrough by means of gas pressure. Insulators (14, 52) are disposed over conductive members comprising the parallel current paths on the opposite side of the contacts from the arc runner to impede any tendency toward arc movement in an undesired direction.

15 Claims, 9 Drawing Figures

6
6
2b
6a
2f
20a
40
24
2
36
28
2a
22
12c
6b
2a
32
6c
18
12e
26
50
38
14
20
20b
2a
4
34
12d
52
8c
23b
8
12
4
23
10
23a
8b
16
30
46d
2e
2a
8a
8e
46
2d
2h
2k
42
46b
44
2g
6

52b
8c
22
8d
12c
12c
8b
12b
34
52
46d
46
8a
10
16
12d
8
8e
12a
12
46a
48
42
46b
48b
44
46c

Fig. 2
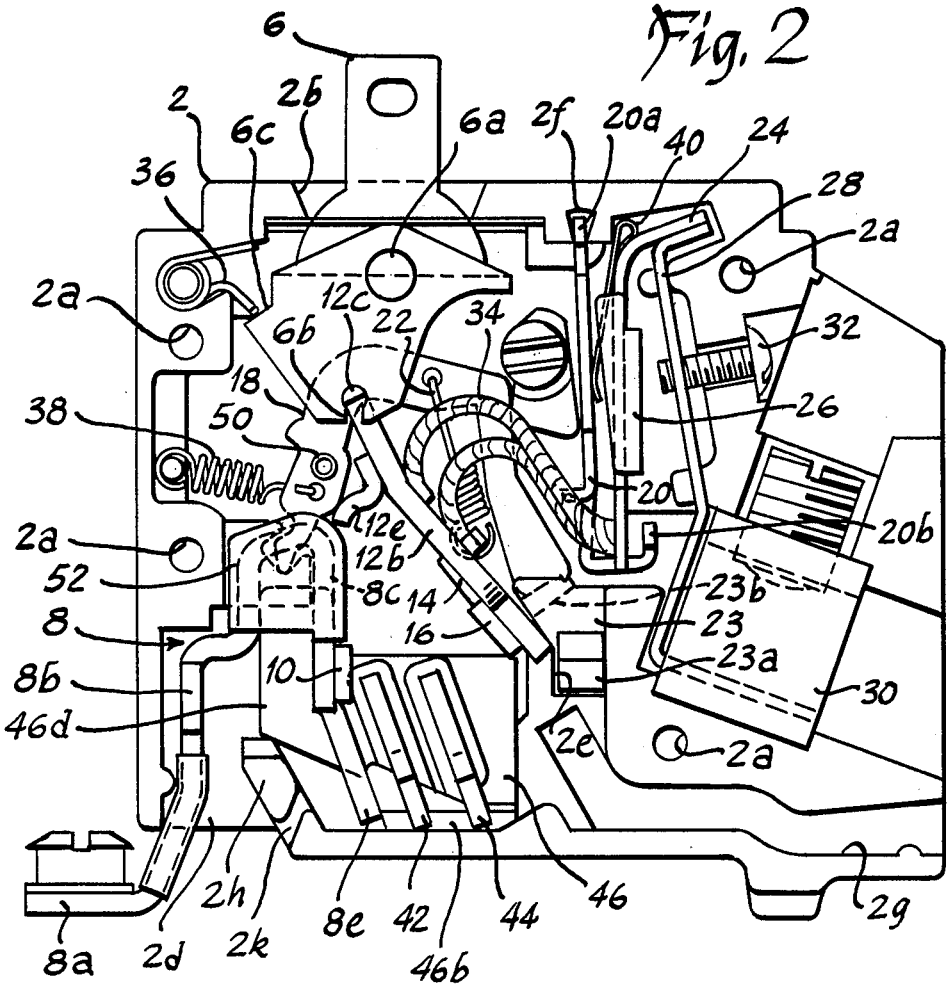
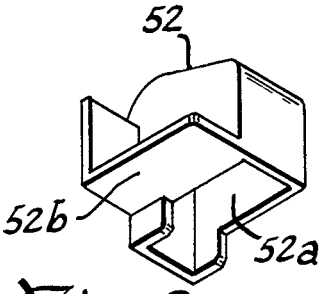
Fig. 9
Fig. 4
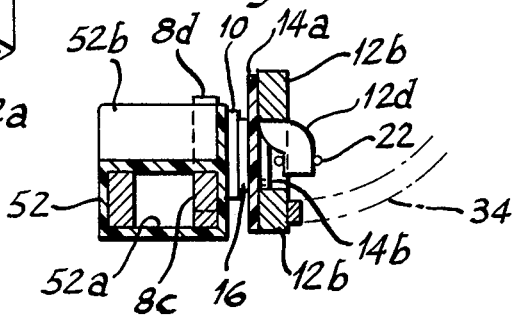

CIRCUIT BREAKER WITH INCREASED CURRENT INTERRUPTING CAPACITY

BACKGROUND OF THE INVENTION

This invention relates to circuit breakers of the molded case, narrow width type such as is shown and described in U.S. Pat. No. 3,081,386 to M. F. Koenig et al. dated Mar. 12, 1963 and owned by mesne assignments by the assignee herein. Circuit breakers of this type are normally utilized in residential and commercial applications up to 240 volts.

Circuit breakers and the panelboards or load-centers to which they mount are designed to be compact and physically compatible with existing apparatus. However, electrical utilities are providing increased available current in new installations. As a result, the short circuit interruption capacity requirement of circuit breakers has increased from 10,000 amps to 22,000 amps for new breaker designs, while existing apparatus designs place severe limitations on changes in physical arrangement and size.

One approach to achieving circuit protecting interruption of high short circuit currents has been to provide parallel, oppositely directed current paths in the circuit breaker, utilizing the blow-apart electromagnetic forces generated by such arrangement to rapidly open the contacts before harmful currents are let through the device into a protected circuit. The structural compactness of the circuit breaker and the location of its current carrying members can present a problem in providing parallel current paths of suitable length to make advantageous use of this electromagnetic force concept. Another problem associted with interruption of currents of the aforementioned magnitude in compact breakers is the extinguishing of the arc resulting from interruption of the circuit. It is important that the arc be extinguished quickly and positively to prevent harmful current from being carried by the arc to the protected circuit. The arc chamber and vent sizes and locations are established by designs of existing apparatus, and therefore must be made more effective within their existing parameters.

SUMMARY OF THE INVENTION

The invention herein described provides a single-pole, thermal and magnetic trip circuit breaker of the narrow width, molded case type having a continuous current rating and short circuit interrupting capacity to meet new available current values with no increase in the physical size of the breaker. The breaker utilizes current-induced electromagnetic repulsion forces to cause early and rapid separation of the contacts under short circuit conditions. The current paths in the stationary and movable contacts are arranged to be directly opposed to take maximum advantage of the electromagnetic force generated by the current in these contact members. The circuit breaker includes an improved arc extinguishing structure which provides a bifurcated, forwardly-angled arc runner, arc plates spaced at an optimum distance and relative angle with respect to the arc runner and to each other to offer minimal resistance to arc motion into the extinguishing structure, and electrical insulators placed on the stationary and movable contact members adjacent the contact elements to protect other elements of the circuit breaker mechanism and to aid in directing the arc into the arc extinguishing structure. A more complete understanding of the invention will be had from the following description and claims when read in conjunction with the accompanying drawings.

BRIEF DESCRIPTION OF THE DRAWINGS

FIG. 2 is a view similar to FIG. 1 but showing the mechanism in a "tripped" position;

FIG. 4 is a sectional view taken along the line 4—4 in FIG. 1 through the stationary and movable contacts of the circuit breaker;

FIG. 9 is an isometric view of an insulating cap used on the stationary contact assembly.

DESCRIPTION OF THE PREFERRED EMBODIMENTS

Figure 1:
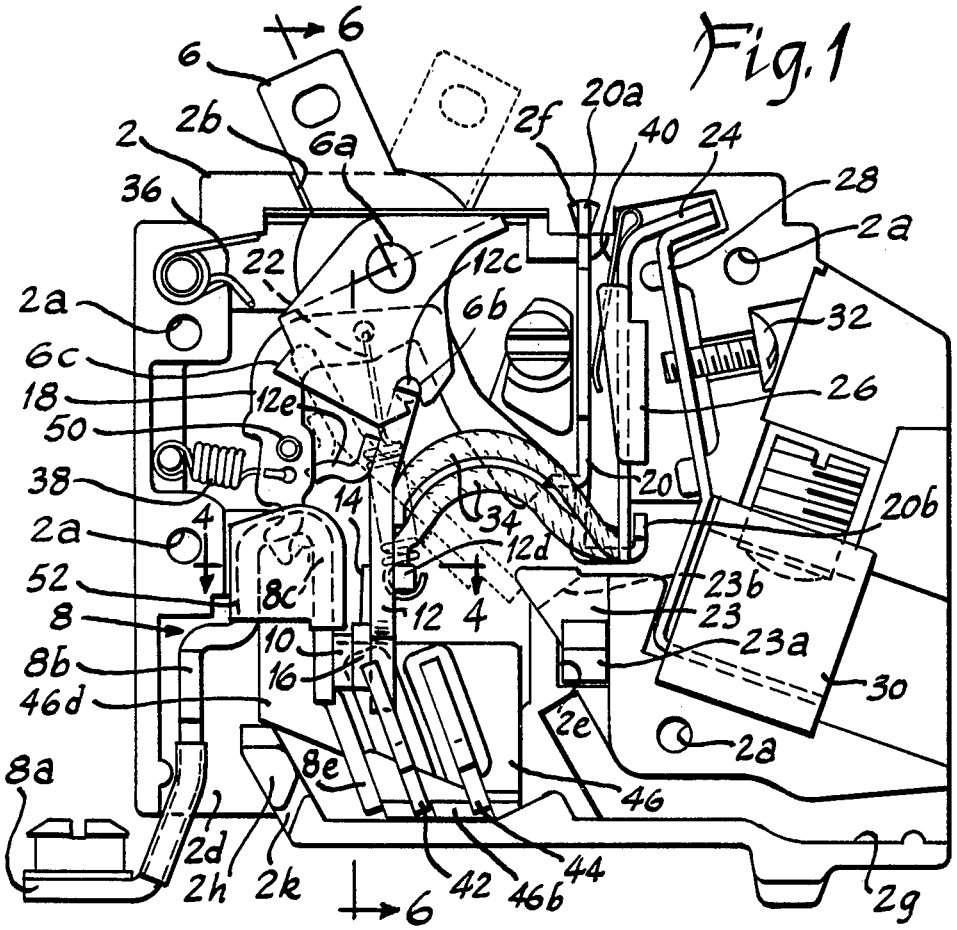
FIG. 1 is a side elevational view of the circuit breaker of this invention with a molded cover removed, showing the mechanism in the "on" condition.
Figure 6:
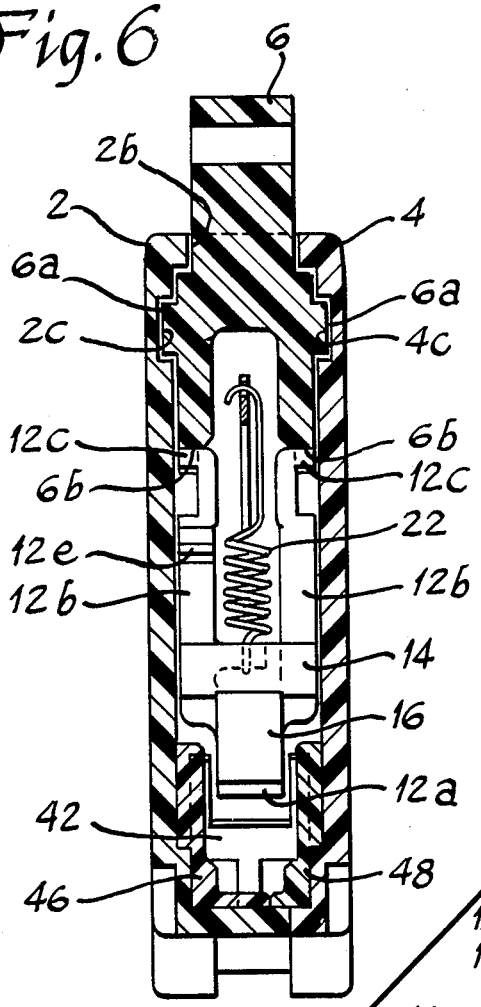
FIG. 6 is a transverse sectional view taken along the line 6—6 in FIG. 1.

Referring to FIGS. 1 and 6 of the drawings, there is shown a circuit breaker having a molded insulating housing 2 which has a shallow cavity formed therein to receive the operating mechanism of the circuit breaker. A molded cover 4 is secured over the open side of the housing 2 by a plurality of rivets (not shown) which are received in openings **2*a* of housing 2 and corresponding openings in the cover 4. The forward or upper wall of housing 2 has an opening 2*b* which cooperates with a similar opening in the cover for receiving an operating handle 6 of the breaker. Operating handle 6 has a pair of trunnions 6*a* which are received in cylindrical recesses 2*c* and 4*c* in the housing and cover, respectively, to journal the handle 6** for pivotal movement.

A combination stationary contact and line-side terminal member 8 is mounted in the lower left-hand portion of the circuit breaker as viewed in FIG. 1, the terminal portion **8*a* projecting outwardly of the housing 2 through an opening 2*d* therein. The combined contact-/terminal member 8 is mounted in the housing 2 and cover 4 by a pair of laterally projecting tabs 8*b* (only one of which is visible in FIGS. 1 and 5) which are formed on the terminal portion and received in complementally formed recesses in the housing 2 and cover 4. The stationary contact portion of member 8 comprises an inverted U-shaped conductor portion 8*c* which has a reduced cross section with respect to the prevalent width of member 8 and is offset to one side of the member 8. The inverted U-shaped conductor portion 8*c* joins with a contact mounting pad 8*d* which is substantially the same width as the terminal portion of the member 8. A stationary contact 10 is secured to the mounting pad 8*d* by any suitable means such as spot welding, brazing, or the like. Projecting downwardly from the contact mounting pad 8*d* is a bifurcated arc runner 8*e* which is angled forwardly in the direction of the side at which the contact 10 is secured to the member 8 to facilitate arc motion off the contact 10** as will be described hereinafter.

Figure 5:
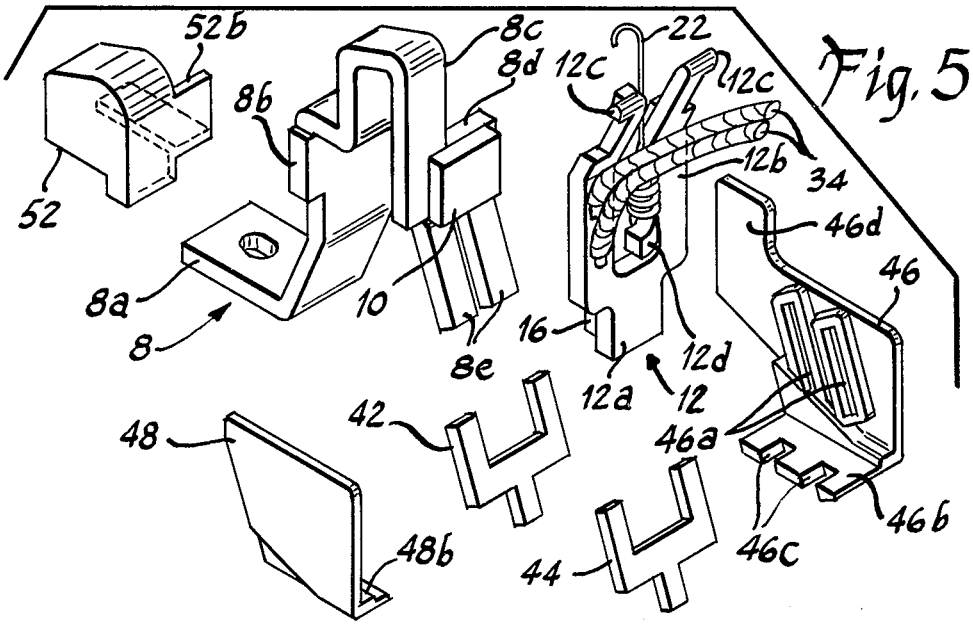
FIG. 5 is an exploded isometric view of the contact and arc extinguishing structures of the circuit breaker of FIGS. 1 to 3.
Figure 8:
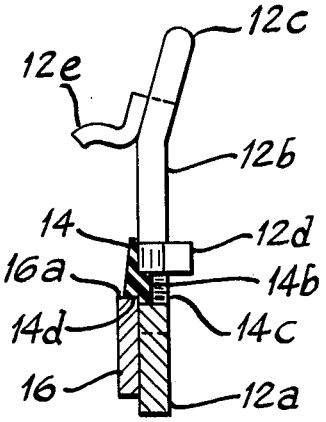
FIG. 8 is a longitudinal sectional view of the assembled movable contact assembly of FIG. 7.
Figure 7:
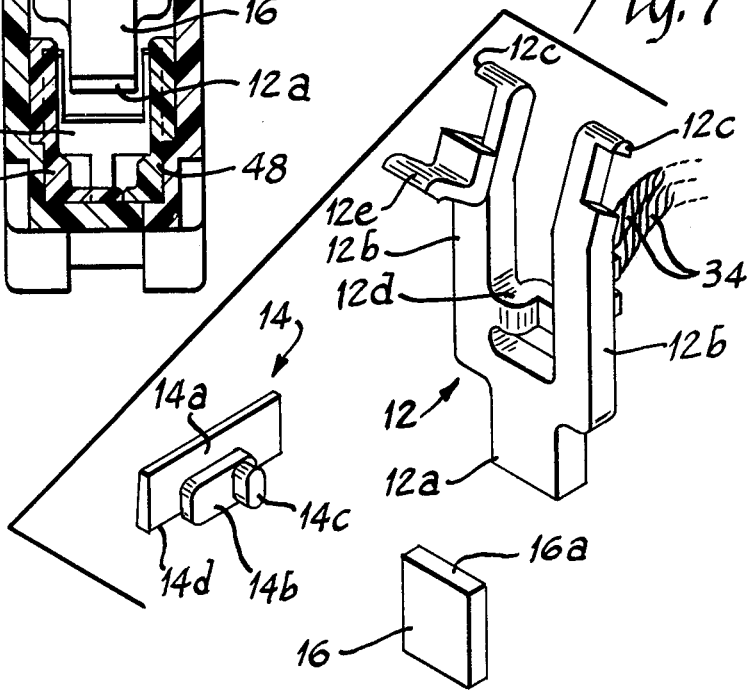
FIG. 7 is an exploded isometric view of elements comprising the movable contact assembly.

As best shown in FIGS. 5 and 7, a movable contact assembly comprises a flat Y-shaped movable contact arm 12 which has a stem portion 12*a* and a pair of upstanding legs 12*b*. The upper portions of legs 12*b* are formed over obliquely out of the plane of contact arm 12 and are provided at the ends with half-round, outwardly projecting ears 12*c* which are cooperatively received within keyhole slots 6*b* formed in depending flanges of the operating handle 6 to pivotally attach movable contact arm 12 to the operating handle 6. A hook 12*d* extends laterally from the housing-side leg 12*b* in the space between the two legs and is offset to the rear, or toward the side of the contact arm 12 opposite the member 8. As may be best seen in FIGS. 7 and 8, an insulator 14 and a contact element 16 are assembled to the movable contact arm 12. Insulator 14 comprises a rectangular cross arm 14*a* which has a rectangular boss 14*b* extending from a back side thereof which in turn has an oblong boss 14*c* extending therefrom to the same side. The rectangular boss 14*b* is made to fit snugly within the opening defined by the upper portion of stem 12*a*, the inner sides of legs 12*b* and the underside of hook 12*d* in the base of the Y-shaped contact arm 12 to prevent movement of the insulator in the plane of the front surface of contact arm 12. The boss 14*c* underlies the portion of hook 12*d* which is offset to the rear of the contact arm 12 to further position the insulator 14 on the arm. Insulator 14 is placed to contact arm 12 such that the cross arm 14*a* lies flat against the flat surfaces of legs 12*b* with the rectangular boss 14*b* received in the aforementioned opening. With reference to FIG. 7, insulator 14 is assembled to contact arm 12 by rotating it ninety degrees counterclockwise in a horizontal plane and inserting the boss 14*b* into the aforedefined opening. As is more apparent in the longitudinal sectional view of movable contact arm 12 shown in FIG. 8, the rectangular boss 14*b* is offset to extend slightly below the bottom edge 14*d* of the cross arm 14*a* to present a forwardly facing surface in the same plane as the back of cross arm 14*a*. Contact element 16 is then secured to the stem portion 12*a* of movable contact arm 12 such that its upper edge 16*a* abuts the lower edge 14*d* of cross arm 14*a* and the upper corner of contact element 16 overlies the forward facing depending portion of rectangular boss 14*b* to trap insulator 14 in place on contact arm 12. Contact element 16 may be secured to arm 12 by any suitable means such as by spot welding, brazing or the like. A portion of stem 12*a* extends below the contact 16 and serves to draw the arc created upon contact separation away from the lower corner of the contact element 16 and direct it to the lower corner of the stem 12*a* of movable contact arm 12 instead. This reduces the erosion of the silver contact resulting from the arcing that occurs at contact separation.

A releasable latch lever 18 is pivotally supported at its left-hand end within a suitable formation in the housing 2. Latch lever 18 is essentially an inverted U-shaped member, the right-hand of which cooperates with a latch member 20 to restrain the latch lever 18 in the position shown in FIGS. 1 and 3. The bight portion of latch lever 18 is disposed between the depending side flanges of operating handle 6 and is provided with a hole which receives one end of a helical tension spring 22. The opposite end of spring 22 is connected to hook 12*d* of the movable contact arm 12 to provide an over center drive for arm 12 in a manner that is well known. Hook 12*d* is offset to the rear side of contact arm 12 and is covered by cross arm 14*a* of insulator 14 to provide protection for the lower loop of spring 22 against the arc which occurs at contact separation. Manual movement of operating handle 6 to the position shown in dotted lines in FIG. 1 carries the upper ends 12*c* of the movable contact arm 12 across the operating center line of spring 22 whereby the movable contact arm is driven to the dotted line position shown in the FIG. 1 against a stop 23 located in the housing 2. Return movement of the operating handle 6 to the position shown in solid lines in FIG. 1 will carry the upper ends 12*c* of movable contact arm 12 back over center of the line of action of spring 22 to cause the movable contact 16 to close upon the stationary contact 10.

Stop 23 is preferably a separate member which is entrapped within the housing 2 and cover 4. At one end the stop 23 is received within a three-sided recess 2*e* in base 2. At the other end stop 23 is provided with a two step rectangular boss 23*a* which is received in a complementally formed recess in cover 4. A slot 23*b* is formed in stop 23 to provide clearance for the lower end of latch lever 18 when the latter is released. The stop 23 is made from a thermosetting plastic material instead of being formed as an integral part of the housing 2, which is made of a glass filled polyester compound, because the thermosetting plastic material has better impact absorbing and wear resistant properties than does the glass filled polyester material.

Figure 3:
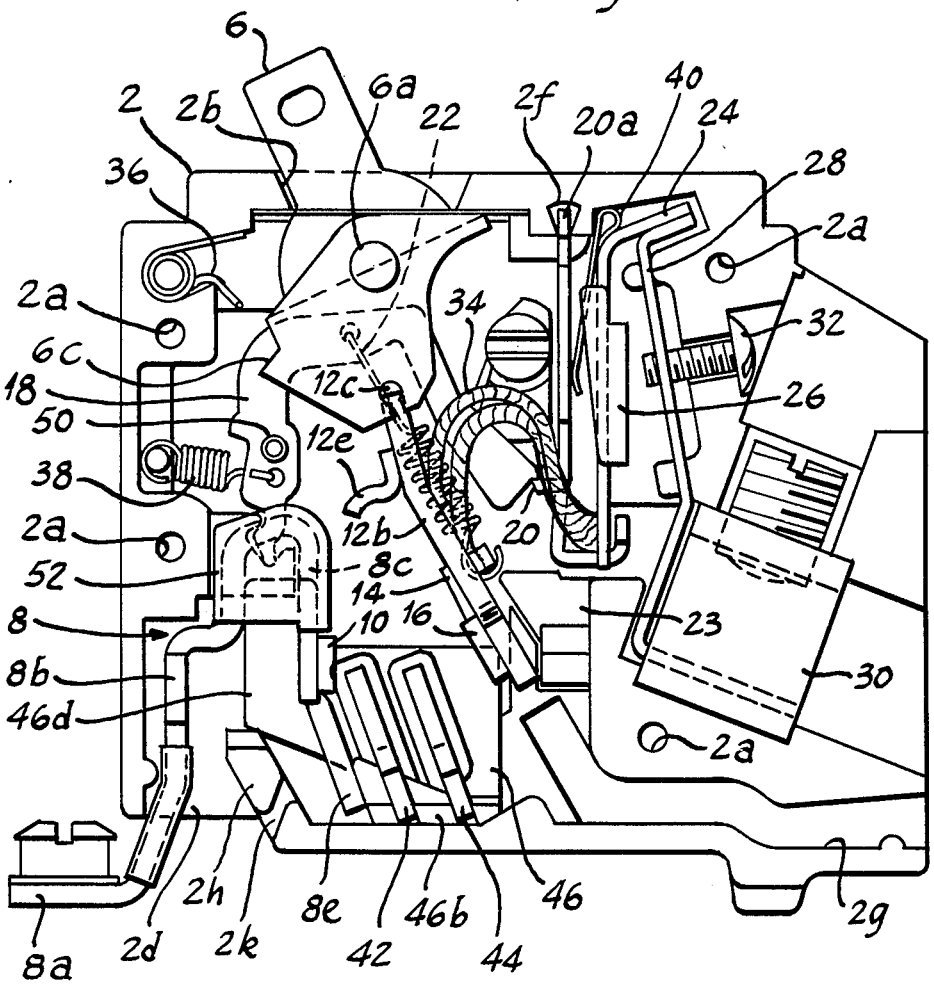
FIG. 3 is a view similar to FIGS. 1 and 2 but showing the mechanism in an "open" position under short circuit conditions.

The latch 20 is a part of a thermal and magnetic overcurrent trip mechanism which further comprises a bimetal member 24 around which is secured a U-shaped pole piece 26. Latch member 20 is pivotally mounted at its upper end by outwardly projecting ears 20*a* which are respectively received within an opening 2*f* in the housing 2 and a similar opening in cover 4 to serve as an armature cooperable with the pole piece 26. The lower end of the latch member 20 is offset horizontally to the left in the drawings to present a latching surface for the cradle member 18 as best seen in FIG. 3. Latch member 20 also comprises a depending hook portion 20*b* which extends around the opposite side of the lower end of bimetal member 24 to be engaged thereby. Bimetal member 24 is mounted within the housing by attachment at its upper end to a conductor 28 which in turn connects to a load-side pressure connector 30. A calibrating screw 32 projects through a slot in the housing 2 and threadably engages an opening in conductor 28 to adjustably position the bimetal 24 and the pole piece 26 within the housing. Bimetal member 24 also has the ends of a pair of braided flexible conductors 34 attached to the left-hand face of its lower end such as by welding or brazing, the opposite ends of conductors 34 being connected to the cover-side leg 12*b* of movable contact arm 12 as viewed in FIG. 1.

As so far described, a circuit can be seen to exist through the breaker when the mechanism is in the "on" position shown in FIG. 1 from the line side terminal 8*a* through the combination terminal and stationary contact member 8, stationary contact element 10, movable contact element 16, the cover-side leg 12*b* of movable contact 12, flexible conductors 34, bimetal 24, conductor 28 and load-side connector 30. In the event that excessive current flows through this circuit, the bimetal element 24 will become heated by the excessive current and will warp toward the right in FIG. 1 to cause its lower end to engage hook portion 24*b* and pull the latch member 20 to the right, thereby disengaging the latch portion from the latch lever 18 and releasing the latch lever to pivot clockwise about its left-hand end under the influence of spring 22. This movement of latch lever 18 carries the upper end of spring 22 over center of the upper ends 12*c* of movable contact arm 12. Once over center, the spring 22 urges the lower end of movable contact arm 12 counterclockwise, or to the right as viewed in FIG. 1, to separate contacts 10 and 16 and abut against stop 23. Spring 22 also drives the upper ends 12*c* of the movable contact arm 12 to the left as viewed in FIG. 1, thereby pivoting handle 6 clockwise until a projection 6*c* thereon engages with the end of a cushion spring 36 held in the upper left-hand corner of the housing 2. The handle then occupies a vertical "tripped" position as shown in FIG. 2 to provide indication that the breaker has tripped.

The breaker mechanism may also be tripped magnetically upon the occurrence of a larger overload current. Magnetic tripping occurs when a relatively large surge of current flows through the bimetal 24, setting up a magnetic field within the pole piece 26 to attract armature 20 to pole piece 26 and thereby moving the latch portion to the right in the same manner as had been previously described in connection with the warping of bimetal 24. Upon removal of the excess current, the breaker may be reset merely by moving the handle 6 back to the "off" position whereby the upper end of movable contact arm 12 is pivoted across the upper end of over center spring 22, thereby further shortening the operating length of spring 22 and reducing its force. A resetting tension spring 38 is connected between a cylindrical boss on the housing 2 and the left-hand, pivoted leg of latch lever 18 to exert a counterclockwise bias on the latch lever 18. As the force on spring 22 is reduced, the force exerted by spring 38 overcomes the clockwise component exerted by spring 22 to move the latch lever in the counterclockwise direction and cause the right-hand end of latch lever 18 to reengage with the latching surface of latch 20. A leaf spring 40 is retained within the housing between bimetal member 24 and latch 20 to bias latch 20 to the left whereby it will reset with the latch lever 18 as the right-hand end of the latch lever is moved into latching position.

It has been a common expedient in breaker designs to include a interaction feature between the releasable latch lever and the movable contact arm such that when the breaker trips and the latch lever is released, the latch lever movement provides some impetus to movement of the movable contact arm. This is accomplished by means of a kicker which may be a portion of the latch lever or a projection attached to the latch lever which engages the movable contact arm. An improved kicker is provided in the breaker of this invention by means of a roll spring pin 50 which is mounted within a hole in the left-hand leg of latch lever 18 to project transversely on opposite sides of the lever. Movable contact arm 12 has a tab 12*e* secured to the housing-side leg 12*b* thereof to project toward the roll pin 50. Tab 12*e* is provided only on one leg of movable contact arm 12 to minimize additional mass of the movable contact and to provide a weld-breaking shear torque on the contacts by causing a twisting moment when pin 50 engages the tab 12*e* as the latch lever is released by latch 20. The keyhole slots 6*b* provide a looseness in the fit of the upper ends 12*c* of the contact arm within the handle and thereby a small, but important, amount of twisting or shear torque can be applied to assist in separating the contacts should they be welded.

Referring again to FIGS. 1 and 5, the circuit breaker of this invention includes an improved arc extinguishing structure which includes a pair of Y-shaped arc plates 42 and 44 and a pair of retainers 46 and 48 for positioning the arc plates within the housing. Retainers 46 and 48 are molded of a glass filled polyester material having a high concentration of trihydrated alumina which emits a cooling gas and water when exposed to an electrical arc. Retainer 46 can be seen in FIG. 5 to have a pair of angularly oriented rectangular pockets 46*a* formed on the interior of a sidewall portion for receiving a leg of the respective arc plates 42, 44. Retainer 46 also has a lateral projecting base 46*b* which has openings 46*c* for receiving the stem of the respective arc plates 42, 44. The sidewall of retainer 46 includes a dog-leg extension 46*d* which projects to the left and upwardly into the area of the stationary contact 8 as may be seen in FIG. 1. Although not specifically shown in FIG. 5, retainer 48 also has angularly oriented pockets similar to pockets 46*a* for receiving the opposite legs of respective arc plates 42, 44. A laterally extending base 48*b* cooperates with base 46*b* to close off the openings 46*c* and trap the stems of arc plates 42, 44 in the openings 46*c* when the arc extinguishing structure is assembled within the circuit breaker. The left-hand edge of retainer 48 is formed complementally to the profile of the right-hand end of terminal/contact member 8, specifically, the pad 8*d* and arc runner 8*e*, and terminates immediately to the right of member 8. Although not specifically shown, the cavity of housing 2 and the interior of cover 4 are suitably configured to position the retainers 46 and 48 in place within the circuit breaker housing. For reasons to be explained more fully hereinafter, it can be seen that the arc plates 42, 44 are disposed substantially parallel to the bifurcated arc runner 8*e* of the terminal/stationary contact member 8 and that the spacing between arc runner 8*e* and arc plate 42 and between arc plates 42 and 44 is substantially equal.

The arc extinguishing structure also comprises a pair of openings in housing 2. The first opening is a passageway 2*g* which extends from the right-hand arc plate 44 to the right-hand end of the housing 2. The second opening is opening 2*d* previously described as an opening through which the terminal 8*a* projected. An upwardly projecting barrier 2*h* extends from the bottom of the circuit breaker housing 2 upwardly into the opening 2*d*, this barrier having a narrow slot 2*k* formed therein. Barrier 2*h* is recessed below the plane of mating surfaces of housing 2 and cover 4 so as not to close off the opening 2*d*, but merely to prevent insertion of foreign objects such as tools, wires, or the like, in any undesired attempt to reach the contacts. Completing the arc extinguishing structure is an insulating cap 52 and the aforedescribed insulator 14. Cap 52 is shown from two different angles in FIGS. 5 and 9, its basic shape being closely similar to the profile of inverted U-shaped conductor portion 8*c* of terminal/stationary contact member 8. The cap 52 is hollow, having opening 52*a* (FIG. 9) to receive the portion 8*c*. A L-shaped flange 52*b* is formed on one side of overlie the wider contact pad 8*d* and to extend under a formation in housing 2 serving as the pivot of latch lever 18. Cap 52 also serves to insulate latch lever 18 and roll pin 50, which are at load-side potential, from the line-side conductor 8*c*. Insulator 14 is disposed directly opposite cap 52 when the contacts 10 and 16 are closed and the two insulating members cooperate to impede any tendency of an arc to travel upwardly along the conducting portions 8c and 12b of the stationary and movable contacts, respectively.

The contact and arc extinguishing structures are designed to be particularly advantageous in the interruption of short circuit currents which, as mentioned previously, can be 22,000 amps. The stationary and movable contacts are formed to provide adjacent parallel, oppositely directed current paths which generate electromagnetic forces tending to separate the two members. Current entering the breaker through terminal 8a is directed downwardly in the right-hand leg of U-shaped conductor portion 8c to the contact mounting pad 8d and into stationary contact 10. That current then passes to movable contact 16, into stem 12a of movable contact arm 12 and upwardly within the cover-side leg 12b to the point at which the braided conductor 34 is attached to that leg 12b. As viewed in FIG. 1, the length of the parallel current paths extends from the junction of the bight of portion 8c with the right-hand leg to the center of the contact element 10 and from the center of contact element 16 to the point at which the braided conductor 34 is attached to leg 12b. By reducing the cross-sectional width of portion 8c and offsetting that portion to the cover side of the terminal/stationary contact member 8, the above described current path in the stationary contact member 8 is essentially aligned directly opposite the current path in the cover-side leg 12b of the movable contact in the direction of movement of the movable contact arm 12.

The occurrence of short circuit currents flowing within the right hand leg of stationary contact member 8 and the cover-side leg of movable contact arm 12 will generate electromagnetic forces that cause the movable contact arm 12 to pivot counterclockwise about its end 12c, thereby separating the contacts. This action occurs much more rapidly than separation of the contacts under the tripping action of the electromagnetic trip means 20, 24, and 26. However, as the contacts separate under the electromagnetic forces of the short circuit current, the current that is let through does generate an electromagnetic tripping force which operates to attract latch 20 to pole piece 26 to release the latch lever 18 and trip the breaker mechanism open as the contact arm 12 moves toward the stop 23 under the electromagnetic forces. Accordingly, at some point in the aforementioned travel of the movable contact arm, the trip mechanism will release latch lever 18 to cause the overcenter spring 22 to drive the contact arm to rest against stop 23 and the breaker to assume the "tripped" position as shown in FIG. 2, thereby preventing reclosure of the contact 16 upon the stationary contact 10 after the short circuit current has been interrupted. The electromagnetic force continues to operate on the movable contact arm as the arm moves to the open position, thereby increasing the opening velocity of the movable contact arm. The opening velocity is enhanced by minimizing the mass of the movable contact arm 12.

Rapid extinction of the arc formed upon contact separation under high currents is necessary to reduce or hold to a minimum the let-through current carried in the arc. The fast opening velocity of the movable contact arm under short circuit conditions establishes a high rate of rise of the arc voltage which in turn reduces the let-through current. The current which is present in the arc and in the right-hand leg of the stationary contact member 8 and the arm 12b of the movable contact 12 establishes a magnetic force which operates to drive the arc onto the arc runner and into the arc plates 42 and 44. The forward inclination of arc runner 8e with respect to stationary contact 10 facilitates arc motion off the contact 10. As the arc moves downward on the arc runner, the pressure resulting from the gas generated by the arc drives the arc gasses through the opening in the arc runner and through the vent opening 2d. The arc gasses are similarly exhausted through right-hand vent passage 2g as the movable contact arm approaches stop member 23. The arc plates 42, 44 are parallel to the arc runner and to each other and the space between arc runner 8e and arc plate 42 is substantially the same as that space between the arc plates 42 and 44. The spacing and parallelism of the arc plates and runner take advantage of the gas generated by the arc and the resulting pressure to further aid in moving the arc into the arc plates. If the plates were positioned radially along the path of the movable contact, the space between the plates at the entry and thereof would provide a restriction to movement therethrough due to gas pressure. By mounting the plates parallel, the space between the plates is the same all along their length and no restriction to movement therethrough is created. Moreover, only two plates, 42 and 44, are used in this structure to permit increased space, and thus less resistance, to fluid flow between the plates. Thus, although the number of arc plates is considerably less than conventional arc chute designs, it is preferable to use fewer plates to achieve greater space therebetween to enable more effective use of the gas generated by the arc to create arc motion.

While the circuit breaker disclosed herein represents a preferred form of the invention, it is to be understood that it is susceptible to various modifications without departing from the scope of the appended claims.

We claim:

1. An electric circuit breaker comprising, in combination:

an insulating enclosing case;

separable contacts disposed within said case;

trip means for causing separation of said contacts in response to overload currents through said contacts;

arc extinguishing means positioned in said case in proximity to said separable contacts;

a contact arm pivoted at an upper end and having spaced legs extending from said pivoted upper end, said legs being joined at the free end of said contact arm; a first one of said separable contacts being secured to a front surface of said contact arm at said free end;

support means positioning a second one of said separable contacts in the arcuate path of travel of said first contact, said support means comprising conductive means extending upwardly from said second contact parallel to said contact arm when said contacts are engaged;

an operating mechanism for selectively causing said pivoted contact arm to move said first contact into and out of engagement with said second contact;

means connected to one of said spaced legs and to said conductive means for causing current to flow in opposite directions therein when said contacts are engaged whereby electromagnetic forces generated by said current flow causes said contact arm to move said first contact out of engagement with said second contact independently of said trip means and said operating mechanism; and said conductive means being offset laterally with respect to said second contact to substantially align said conductive means with said one leg of said contact arm in the direction of motion of said contact arm.

2. The electric circuit breaker according to claim 1 wherein:

said one leg and said conductive means have rectangular cross-sectional configurations.

3. The electric circuit breaker according to claim 2 wherein:

said contact arm is a substantially planar member having a central opening establishing said spaced legs along lateral edges of said contact arm.

4. The electric circuit breaker according to claim 3 wherein:

said contact arm includes an insulator secured to said front surface thereof above said first contact.

5. The electric circuit breaker according to claim 4 wherein:

said contact arm comprises a projection on one of said legs within said central opening and spaced above the portion joining said legs at the free end of said contact arm;

said insulator comprises a cross bar abutting front surfaces of said legs and spanning said central opening and a boss extending rearwardly from said cross bar into said central opening between said projection and said joining portion, said boss engaging said legs, said joining portion and said projection to prevent movement of said insulator in the plane of said front surface of said contact arm, said boss being offset downwardly from said cross bar to present a front facing surface coplanar with the front surface of said contact arm; and said first contact is secured to said front surface of said contact arm to overlie said front facing surface of said boss for trapping said insulator to said contact arm.

6. The electric circuit breaker according to claim 5 wherein:

said operating mechanism comprises resilient means connected to said projection and said cross bar overlies said projection.

7. The electric circuit breaker according to claim 1:

further comprising insulating means disposed on said conductive means.

8. The electric circuit breaker according to claim 7 wherein:

said conductive means includes a reflex portion at the upper end thereof extending away from said contact arm; and said insulating means comprises a hollow insulating cap disposed over said reflex portion extending downward along all sides toward said second contact.

9. The electric circuit breaker according to claim 4:

further comprising insulating means disposed on said conductive means in juxtaposition to said insulator on said contact arm, said insulating means and said insulator cooperating to impede upward movement of an arc formed by separation of said contacts.

10. The electric circuit breaker according to claim 3 wherein:

said trip means comprises a latch member releasable in response to overload currents for causing said contact arm to move said first contact out of engagement with said second contact;

said contact arm includes a second projection on the other of said spaced legs extending forwardly from said other leg; and means on said latch member for engaging said second projection upon release of said latch member to impart a hammer-like blow to said contact arm at a lateral edge, thereby to provide a twisting moment to said contact arm which serves to break a weld between said contacts.

11. The electric circuit breaker according to claim 3:

further comprising stop means disposed in said case in the arcuate path of travel of said contact arm to limit contact separating movemet of said contact arm, said stop means comprising a separate stop member being complementally received within formations formed on the interior of said case.

12. The electric circuit breaker according to claim 11 wherein:

said stop member comprises a material having impact and wear-resistance properties which are superior to the material of which said case if formed.

13. The electric circuit breaker according to claim 1 wherein:

said arc extinguishing means comprises:

an arc runner integral with said support means and extending downwardly from said second contact;

a vent opening in said case located in proximity to said arc runner and on a side thereof opposite said contact arm; and an aperture in said arc runner, whereby an arc formed by separation of said contacts is drawn away from said contacts on said arc runner and gasses associated with said arc are vented exteriorly of said case through said slot and said vent opening.

14. The electric circuit breaker according to claim 13 wherein:

said arc runner is angularly disposed in the direction of contact separating movement; and said arc extinguishing means further comprises a plurality of arc plates spaced along the path of travel of said contact arm, said arc plates being disposed parallel to said arc runner and having aligned slots open to the upper ends thereof for permitting the free end of said contact arm to pass therethrough during movement of said contact arm.

15. The electric circuit breaker according to claim 14 wherein:

said arc extinguishing means further comprises a pair of arc plate retainers disposed in said case along opposite lateral edges of said arc plates, said retainers being complementally received within formations on the interior of said case and having formations on the facing surfaces for receiving the lateral edges of said arc plates, said retainers being molded of an insulating material which generates an arc cooling liquid when exposed to heat.

* * * * *